US009974417B1

(12) United States Patent
Harris

(10) Patent No.: US 9,974,417 B1
(45) Date of Patent: May 22, 2018

(54) DEVICE FOR AIDING IN BATHING

(71) Applicant: Rodney Harris, San Leandro, CA (US)

(72) Inventor: Rodney Harris, San Leandro, CA (US)

( * ) Notice: Subject to any disclaimer, the term of this patent is extended or adjusted under 35 U.S.C. 154(b) by 0 days. days.

(21) Appl. No.: 15/661,391

(22) Filed: Jul. 27, 2017

(51) Int. Cl.
*A47K 7/02* (2006.01)
*A47L 13/12* (2006.01)

(52) U.S. Cl.
CPC ..... *A47K 7/022* (2013.01); *A47L 13/12* (2013.01)

(58) Field of Classification Search
CPC ..... A47K 7/022; A47L 13/12
See application file for complete search history.

(56) References Cited

U.S. PATENT DOCUMENTS 1,540,326 A 6/1925 Glowa
1,954,940 A 4/1934 Mikel
2,414,321 A 1/1947 Miller
2,501,426 A 3/1950 Voorhees
4,184,221 A 1/1980 Edwards
4,282,623 A 8/1981 Gacuzana
4,449,266 A * 5/1984 Northemann ..... A46B 5/00 15/167.2
5,222,272 A 6/1993 Park
5,277,389 A 1/1994 Ballares et al.
5,537,709 A 7/1996 Taragos
5,784,722 A 7/1998 Ureta et al.
6,221,034 B1 4/2001 Chaplin
2014/0345072 A1* 11/2014 Krasnick ..... A46B 5/0066 15/106

* cited by examiner

*Primary Examiner* — Randall Chin
(74) *Attorney, Agent, or Firm* — Richard L. Miller

(57) ABSTRACT

A device for aiding in bathing having a first sponge cleaning material and a second bristle cleaning material. The first sponge cleaning material is disposed on an exterior side of a first arm, and the second bristle cleaning material is disposed on an exterior side of a second arm. The first arm and second arm are connected to a handle at a common point, forming a Y shape. The first arm and second arm have flexural strengths less than that of the handle, providing a flexible structure that conforms to a user's body.

3 Claims, 2 Drawing Sheets

DEVICE FOR AIDING IN BATHING

BACKGROUND OF THE INVENTION

Field of the Invention

The present invention relates to a device for aiding in bathing, and more particularly, a rubbing and scrubbing brush for dual use.

Description of the Prior Art

Numerous innovations for brushes have been provided in the prior art that will be described. Even though these innovations may be suitable for the specific individual purposes to which they address, however, they differ from the present invention.

A FIRST EXAMPLE, U.S. Pat. No. 1,540,326, Published/Issued on Jun. 2, 1925, to Glowa teaches improvements in brushes and more particularly to such types as are used for sweeping and like purposes in which a handle disposed at an angle is used.

A SECOND EXAMPLE, U.S. Pat. No. 1,954,940, Published/Issued on Apr. 17, 1934, to Mikel teaches washing and massaging devices for use in bath tubs and has for one of its objects to provide such a device with means whereby it can be 'detachably and adjust' ably attached to any portion of the inside surface of the bath tub.

A THIRD EXAMPLE, U.S. Pat. No. 2,414,321, Published/Issued on Jan. 14, 1947, to Miller teaches a bathbrush having a handle means and a head mounted on the handle means for universal movement, so that the position of the head automatically changes to conform to the body of the bather. The bath brushes in general useembody fixed heads and when such a conventional brush is employed to wash the bathers back the brush head does not conform to the body but only its edge portions come into use. In the brush of the present invention the head has a universal mounting and automatically moves into full, effective engagement with the body of the bather.

A FOURTH EXAMPLE, U.S. Pat. No. 2,501,426, Published/Issued on Mar. 21, 1950, to Voorhees teaches a scrubbing brush wherein the Water is conducted from a source of pressure through a flexible hose to a hollow handle and thence through the hollow handle and brush to the place where the water is required.

A FIFTH EXAMPLE, U.S. Pat. No. 4,184,221, Published/Issued on Jan. 22, 1980, to Edwards teaches a bath brush having an elongated, continuously curved element terminating in a handle at one end portion and in a brush arrangement at the other end portion thereof. The element is curved continuously at a rate of curvature comparable to a clothes hanger. The brush arrangement includes an enlarged head forming a substantially planar surface from which project codirectionally a plurality of bristles, with the brush arrangement further including a pair of clips disposed on either side of the bristles for removably holding a face cloth, and the like, on the enlarged head of the element so as to cover the bristles in order to facilitate bathing with the brush.

A SIXTH EXAMPLE, U.S. Pat. No. 4,282,623, Published/Issued on Aug. 11, 1981, to Gacuzana teaches a scrubber head has a handle with connections for parallel hoses to an adaptor which is interposed between a shower supply line and a shower head. A first valve in the scrubber head prevents water flow to the scrubber head or to the shower head. A second valve selectively flows water to a channel to turn a power disc. A parallel connected scrubber disc has a surface cover with microhook or loop-type fasteners to hold complementary fasteners on an annular scrubber pad. An annular sponge is mounted on a ring on the head outward of the scrubber pad for preventing splashes. The second valve may direct water through the channel and a spray head mounted centrally in the discs or back to the shower head.

A SEVENTH EXAMPLE, U.S. Pat. No. 5,222,272, Published/Issued on Jun. 29, 1993, to Park teaches plural through-holes are placed at a certain interval spacing on and along the grip of a brush to avoid slipping. Brush teeth and hard materials are implanted in a brush teeth implantation portion of the brush to facilitate the circulation of blood. The base and gripping portion of a rolling brush are connected by latches in opposite directions, and rotating directions can be selected at will. A passage is set along the center axis of the base of the brush, and plural connecting holes are arranged in the passage, reaching through to an outside round surface of the brush base. Implantation density of the brush teeth in the brush teeth implantation portion is not uniform.

AN EIGHTH EXAMPLE, U.S. Pat. No. 5,277,389, Published/Issued on Jan. 11, 1994, to Ballares, et al. teaches a back scrubber to be used in the shower includes a holder which is ordinarily adhered to the shower wall by suction cups and which has a releasable and reversible sponge thereon which can be quickly replaced or used without removing the holder from the wall.

A NINTH EXAMPLE, U.S. Pat. No. 5,537,709, Published/Issued on Jul. 23, 1996, to Taragos teaches a back scrubber device comprises an elongate belt formed of flexible material and having a soap impregnated pad detachably mounted thereon. In the preferred embodiment, the belt is molded to form a plurality recesses for receiving mounting members thereon. The recesses have dove-tailed grooves and the mounting members have beveled edges to define a tongue and groove arrangement. The mounting members have penetrating elements which provide means for mounting the pad on the belt.

A TENTH EXAMPLE, U.S. Pat. No. 5,784,722, Published/Issued on Jul. 28, 1998, to Ureta, et al. teaches a back scrubber for removable installation in a shower, a preferred embodiment of which includes a housing having a rear wall and a plurality of side wall segments peripherally of the rear wall, each of the side wall segments having an inwardly disposed lip therealong. A sponge is releasably held by the housing and has a thickness greater than the depth of the side wall segments for being retained along the sponge's thickness by the lips along the side wall segments.

AN ELEVENTH EXAMPLE, U.S. Pat. No. 6,221,034, Published/Issued on Apr. 24, 2001, to Chaplin teaches a back scratcher including an elongated slender stem having a handle disposed at a first end thereof and a scratching head disposed at a second end of said stem. The stem includes a substantially arcuate form, the handle and the scratching head being oriented at an obtuse angle one to another thereby. The scratching head has bristles extending laterally therefrom. The handle has an elongated handle portion extending in either direction from the first end and a plane defined by said stem whereby, when the handle is grasped with one hand portion placed against the palm of the user and a finger is positioned along the other handle portion and the stem is placed over the shoulder or around the waist, the bristles are aligned to engage the back of the user. The stem is preferably further defined by a substantially uniform radius in a side view thereof and planar in a front view thereof. An enlargement at a distal end of each said handle portion for enhanced gripping of said handle and manipulation of said scratching head is also provided.

It is apparent now that numerous innovations for scrubbers and for back-cleaning or scratching devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide DEVICE FOR AIDING IN BATHING that avoids the disadvantages of the prior art.

ANOTHER OBJECT of the present invention is to provide DEVICE FOR AIDING IN BATHING that is simple and inexpensive to manufacture.

STILL ANOTHER OBJECT of the present invention is to provide DEVICE FOR AIDING IN BATHING that is simple to use.

BRIEFLY STATED, STILL YET ANOTHER OBJECT of the present invention is to provide DEVICE FOR AIDING IN BATHING that is easily reversed for allowing switching between a sponge material and a bristle material.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawings are briefly described as follows.

A MARSHALING OF REFERENCE NUMERALS UTILIZED IN THE DRAWINGS

Figure 1:
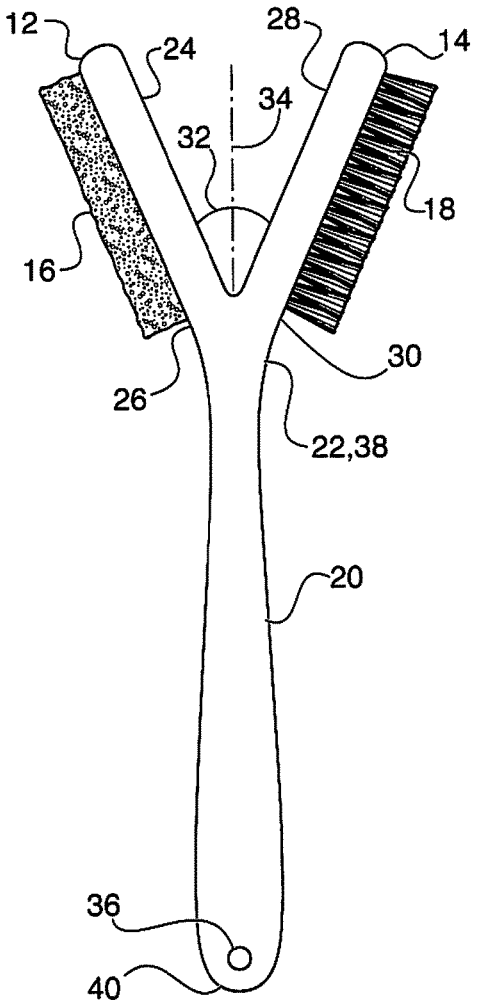
FIG. 1 is a diagrammatic plan view illustrating an embodiment of a DEVICE FOR AIDING IN BATHING.

10 device for aiding in bathing
12 first arm
14 second arm
16 first sponge cleaning material
18 second bristle cleaning material
20 handle
22 common point
24 interior side of first arm
26 exterior side of first arm
28 interior side of second arm
30 exterior side of second arm
32 angle formed between interior side of first arm and interior side of second arm
34 bisector of angle formed between interior side of first arm and interior side of second arm
36 bore of handle
38 proximal end of handle
40 distal end of handle

DETAILED DESCRIPTION OF THE PREFERRED EMBODIMENT

Referring now to the figures, in which like numerals indicate like parts, and particularly to FIG. 1, disclosed is a device 10 for aiding in bathing which includes:

a) a first arm 12;
b) a second arm 14;
c) a first cleaning material 16;
d) a second cleaning material 18; and
e) a handle 20.

The first arm 12 and the second arm 14 extend from the handle 20. The first cleaning material 16 is disposed on the first arm 12. Likewise, the second cleaning material 18 is disposed on the second arm 14. The first arm 12 and the second arm 14 extend from the handle 20 at a common point 22. This structure facilitates using either the first cleaning material 16 or the second cleaning material 18 interchangeably by a user since they both extend from the same point on the handle 20 and therefore both will involve the same basic grip and motion to use.

The first arm 12 has an interior side 24 and an exterior side 26. Likewise, the second arm 14 has an interior side 28 and an exterior side 30. The first cleaning material 16 is disposed on the exterior side 26 of the first arm 12. The second cleaning material 18 is disposed on the exterior side 30 of the second arm 14.

The first arm 12 and the second arm 14 extend from the handle 20 at the common point 22 and thereby form a Y shape. In doing so, the interior side 24 of the first arm 12 faces substantially towards the interior side 28 of the second arm. Likewise, the interior side 28 of the second arm 14 faces substantially towards the interior side 24 of the first arm 12.

Figure 2:
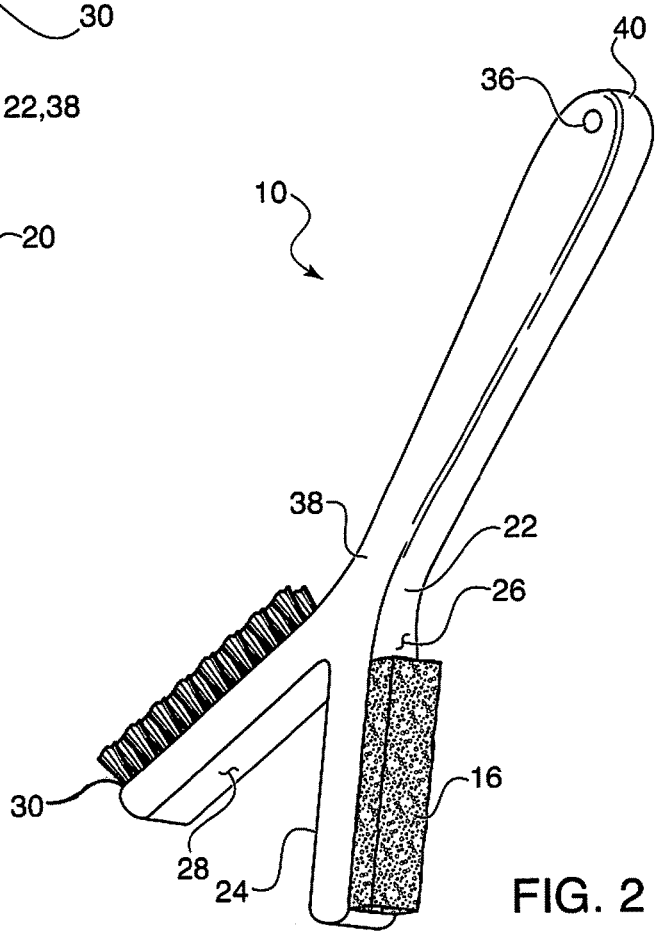
FIG. 2 is a diagrammatic perspective thereof.
Figure 3:
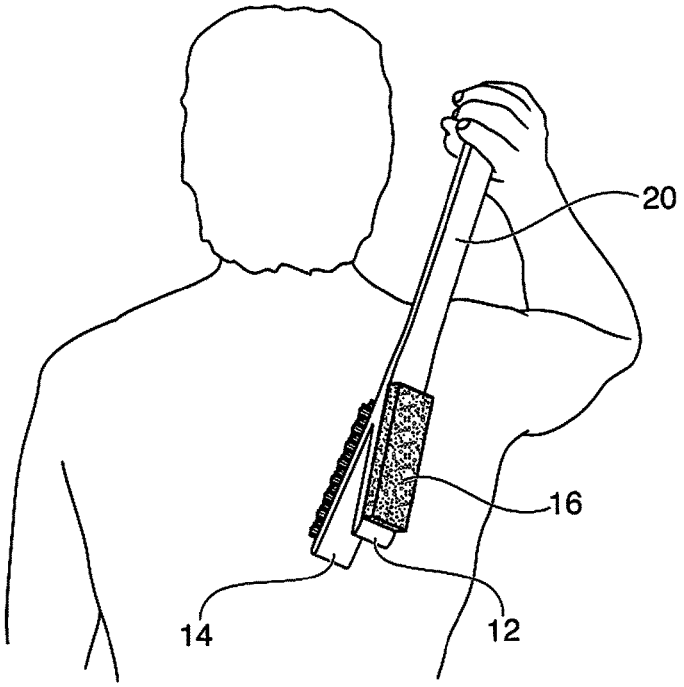
FIG. 3 is a illustrates a user utilizing the invention as brush.
Figure 4:
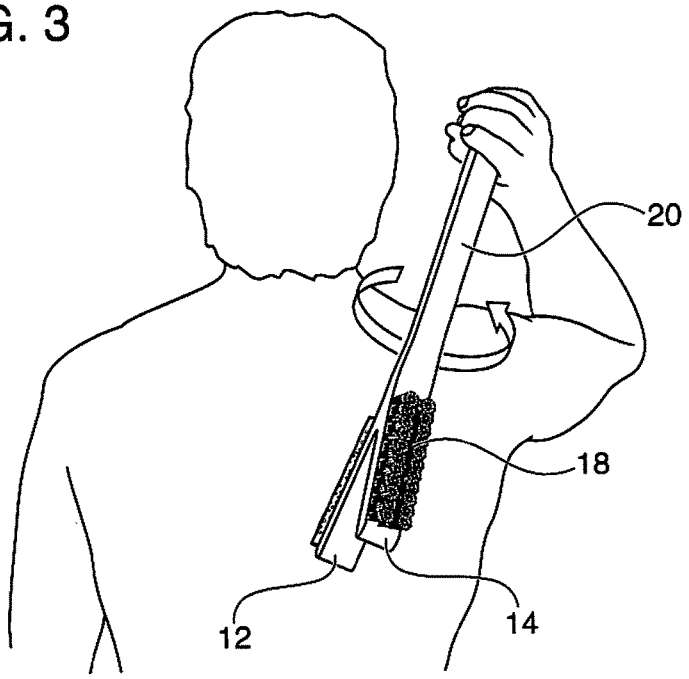
FIG. 4 is a illustrates a user utilizing the invention as rubbing sponge.

In the preferred construction, and as illustrated in FIGS. 1-4, the first cleaning material 16 is a sponge cleaning material, and the second cleaning material 18 is a bristle cleaning material. As illustrated in FIGS. 3 and 4, this permit a user to flip the device to either have a sponge or scrubbing brush for cleaning purposes, especially for cleaning of a person's back.

As most clearly illustrated in FIG. 1, an angle 32 is formed between the interior side 24 of the first arm 12 and the interior side 28 of the second arm 14. The angle 32 is at minimum 10 degrees. The angle is at a maximum 100 degrees. The angle 32 formed between the interior side 24 of the first arm 12 and the interior side 28 of the second arm 14 has a bisector 34. The bisector 34 runs through the handle 14.

This structure facilitates the use of the device as a back cleaner, because the angled structure on both sides causes the device to be properly angled to more easily scrub a user's back without excessive reaching. The range of angles 32 illustrated is that which facilitates such advantage, as an angle 32 less than 10 degrees would provide little advantage in terms of less reaching, and an angle in excess of 100 degrees would involve the handle 20 bumping into a user's shoulder before the first sponge cleaning material 16 or second bristle cleaning material 18 would be in contact with the user's back.

As illustrated in FIGS. 1 and 2, the handle 20 further includes a bore 36. The bore 36 is intersected by the bisector 34 of the angle 32 formed between the interior side 24 of the first arm 12 and the interior side 28 of the second arm 14. The bore being in this position provides an advantage in that hanging the device 10 from a hook or via a string will balance evenly.

In the preferred construction, the first arm 12 and the second arm 14 are composed of a material which is capable of flexing without breaking. Further to this, the first arm 12 has a flexural strength. The second arm 14 has a flexural strength. The handle 20 has a flexural strength (also known as a modulus of rupture, or a bend strength). The flexural strength of the handle 20 is greater than the flexural strength of the first arm 12. The flexural strength of the handle 20 is likewise greater than the flexural strength of the second arm 14.

The handle 20 has a proximal end 38 and a distal end 40. The proximal end 38 of the handle is at the aforementioned common point 22 where the first arm 12 and second arm 14 extend from the handle 20. The distal end 40 is opposite the proximal end 38. The flexural strength of the handle 20 varies over the length of the handle 20. The flexural strength of the handle 20 is greater at the distal end 40 of the handle 20 than at the proximal end 38 of the handle 20 when measured over a span constituting at least one fourth of the length of the handle 20.

This structure of variable flexural strengths assures that the device 10 as a whole flexes when utilized by a user, and in particular that the device 10 flexes more towards the first sponge cleaning material 16 or second bristle cleaning material 18, thus providing a maximum cleaning opportunity to a user and helping the device to conform to the back by flexing to the appropriate relative angle.

It will be understood that each of the elements described above, or two or more together, may also find a useful application in other types of constructions differing from the types described above.

While the invention has been illustrated and described as embodiments of DEVICE FOR AIDING IN BATHING, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for aiding in bathing which comprises:

a) a first arm;

b) a second arm;

c) a first cleaning material;

d) a second cleaning material; and e) a handle;

wherein said first arm and said second arm extend from said handle;

wherein said first cleaning material is disposed on said first arm;

wherein said second cleaning material is disposed on said second arm; and wherein said first arm and said second arm extend from said handle at a common point;

wherein said first arm has an interior side and an exterior side;

wherein said second arm has an interior side and an exterior side;

wherein said first cleaning material is disposed on said exterior side of said first arm; and wherein said second cleaning material is disposed on said exterior side of said second arm;

wherein said first arm and said second arm extend from said handle at said common point and thereby form a Y shape;

wherein said interior side of said first arm faces substantially towards said interior side of said second arm; and wherein said interior side of said second arm faces substantially towards said interior side of said first arm wherein an angle is formed between said interior side of said first arm and said interior side of said second arm;

wherein said angle is at minimum 10 degrees; and wherein said angle is at a maximum 100 degrees;

wherein said angle formed between said interior side of said first arm and said interior side of said second arm has a bisector; and wherein said bisector runs through said handle;

wherein said handle further comprises a bore; and wherein said bore is intersected by said bisector of said angle formed between said interior side of said first arm and said interior side of said second arm;

wherein said first arm and said second arm are composed of a material which is capable of flexing without breaking;

wherein said first arm has a flexural strength;

wherein said second arm has a flexural strength;

wherein said handle has a flexural strength;

wherein said flexural strength of said handle is greater than said flexural strength of said first arm; and wherein said flexural strength of said handle is greater than said flexural strength of said second arm.

2. The device of claim 1 wherein said first cleaning material is a sponge cleaning material; and wherein said second cleaning material is a bristle cleaning material.

3. The device of claim 1 wherein said handle has a proximal end and a distal end;

wherein said proximal end of said handle is at said common point;

wherein said distal end is opposite said proximal end;

wherein said flexural strength of said handle varies over the length of said handle; and wherein said flexural strength of said handle is greater at said distal end of said handle than at said proximal end of said handle when measured over a span constituting at least one fourth of the length of said handle.

* * * * *